US005833152A

United States Patent [19]

Galanty

[11] Patent Number: 5,833,152

[45] Date of Patent: Nov. 10, 1998

[54] INTEGRATED COMMINUTING SCREENING AND SHREDDING SYSTEM FOR LIQUID WASTE CHANNELS

[76] Inventor: William B. Galanty, 21 Delwick La., Short Hills, N.J. 07078

[21] Appl. No.: 885,778

[22] Filed: Jun. 30, 1997

[51] Int. Cl.[6] ..... B02C 18/40

[52] U.S. Cl. ..... 241/46.02; 241/46.06; 241/73; 241/141; 241/236; 241/243

[58] Field of Search ..... 241/46.01, 46.06, 241/73, 166, 167, 141, 142, 236, 243, 46.02

[56] References Cited

U.S. PATENT DOCUMENTS

| | | | |
|---|---|---|---|
| 2,305,935 | 12/1942 | Thom | 241/243 |
| 2,342,927 | 2/1944 | Durdin, Jr. | 210/174 |
| 2,648,365 | 8/1953 | Lacout | 241/243 |
| 2,921,683 | 1/1960 | Strenz et al. | 210/174 |
| 4,186,888 | 2/1980 | Galanty | 241/46.06 |
| 4,919,346 | 4/1990 | Chambers, Sr. | 241/46.02 |
| 5,061,380 | 10/1991 | Stevenson | 210/768 |
| 5,186,401 | 2/1993 | Herdman et al. | 241/46.01 |
| 5,505,388 | 4/1996 | Chambers et al. | 241/46.02 |
| 5,628,467 | 5/1997 | Graveman | 241/88.4 |

*Primary Examiner*—John M. Husar
*Attorney, Agent, or Firm*—Clay Holland, Jr.

[57] ABSTRACT

An integrated unitary comminuting system adapted for wastewater channel use is provided with devices which include a stationary single or dual semi-cylindrical-like sizing and sweeping screen member each having a rotating sweeping mechanism of interactive slotted comb bars or blades with tynes or teeth, so as to sweep and clear lodged or agglomerated solids adhering to the outer circumference surface of the semi-cylindrical-like screen member, disposed in spaced apart contiguous parallel relationship with a twin shaft shredder device having two parallel shafts with shredder or grinder teeth along the length thereof that rotate in opposite senses. The unitary system of devices may be positioned perpendicular between the influent and effluent side of the wastewater flow in a channel so that solids therein will encounter the semi-cylindrical-like sizing and sweeping screen members or the twin shaft shredder as the wastewater flows through the channel. Both the single or dual stationary semi-cylindrical-like screen devices cause solids which do not flow directly therethrough to be forcefully swept and diverted from the outer surfaces of the stationary sizing screen members by the rotating sweeping interactive blades mechanism of the system into surrounding the wastewater flow so as to cause and divert or direct the solids to flow into the twin shaft shredder device, aided by circulating wastewater currents generated in the wastewater flow near the entrance to the twin shaft shredder which is generated in part by the rotating sweeping interactive blades of the screening devices, whereupon the removed solids are efficiently channelled into the twin shaft shredder device along with the other wastewater and solids flow where they are reduced in particle size.

25 Claims, 4 Drawing Sheets

INTEGRATED COMMINUTING SCREENING AND SHREDDING SYSTEM FOR LIQUID WASTE CHANNELS

FIELD OF THE INVENTION

This invention relates to comminuting systems for wastewater channel use, where the system is placed in a wastewater channel between the influent and effluent flow of the channel so that large size and agglomerated solids flowing in the channel are reduced in size by shredding as they flow through the comminuting system. Such comminuting systems are designed to enhance the efficiency of processing of wastewater containing solids within the channel by screening out large size and agglomerated solids and then subsequently shredding them into minute size particles which results in continuous flow of the wastewater containing reduced particle size solids, to thereby enhance the efficient flow of the wastewater through the channel.

BACKGROUND OF THE INVENTION

In the prior art processing of sewage and wastewater often involve handling large volumes of sewage and wastewater flow in a channel to separate solid and agglomerated matter therein and comminuting such matter by means of various screening and shredding devices in combination which are disposed in the wastewater flow within the channel.

In U.S. Pat. No. 2,342,927, issued Feb. 29, 1944, to A. C. Durdin, Jr., entitled "COMMINUTOR", there is disclosed a comminutor in which a liquid is caused to pass around a screen with a whirling or rotating movement relative to its direction a flow. The rotating movement or whirling of the stream causes all solids therein, both the normally floating solids and the normally sunken solids, to perform orbits within the floating stream. Since the stream is draining through the screen, the solids are presented to the screen at various levels, ranging from water level down to the bottom of the screen. These solids are held against the screen by water pressure and are transferred to cutting mechanism, where they are comminuted. Thus, the cutting operation is distributed through the whole submerged depth of the screen and therefore no excessive wear occurs from normally floating solids at the water level and from normally sunk solids at the bottom of the screen.

In another prior art patent, U.S. Pat. No. 2,921,683, issued Jan. 19, 1960, to Karl Strenz, and Gerg Dankesreither, entitled "APPARATUS FOR DISINTEGRATING AND AUTOMATICALLY SCREENING COARSE FLOWING MATTER CARRIED IN LIQUID", there is disclosed a device comprising a revolving drum screen consisting of several grates that are provided with slots staggered along the circumference of the drum. A plurality of combs form close fits with the slots, simultaneously grazing the surface of the drum screen and consequently, the notches of the grate bars act as disintegrating tools.

In yet another prior art patent, U.S. Pat. No. 2,933,189, issued Apr. 19, 1960 to Anne Jellesma, entitled "SYSTEM FOR HANDLING SEWAGE WATER AND THE LIKE", there is disclosed a system for handling sewage water which comprises the combination of a stationary drum-like screen or strainer, and one or more comminuters associated with the screen or strainer and serving to reduce the solids which are intercepted thereby. The comminutors are disposed, at least in part under the level of the incoming liquid and each of the communitors bears rotatably on a supporting member associated with the comminuter. A support arrangement rotatable about the axis of the stationary drum-like screen or strainer carries all of the supporting members associated with the comminuters present in the system.

In still another patent, U.S. Pat. No. 5,061,380, issued Oct. 29, 1991, to Christopher Stevenson, entitled "SCREENING SYSTEM AND METHOD", there is disclosed a device for screening a liquid material having solids matter suspended in it which comprises a number of sets of discs, the discs of each set is rigidly mounted on a shaft being separated from one another axially, means mounting the shafts about parallel axis, with the discs of adjacent shafts being interleaved with one another and means to cause the shafts to rotate independently in the same rotational sense such that successive shafts rotate progressively faster to cause the solid matter suspended in the liquid material to be moved in a direction from slowest shaft to the fastest shaft. The device is used particularly in sewage processing plants. This design has been shown to be excessively complicated having numerous individual rotating disks and multiple shafts each requiring individual seals and drive mechanism. Upon the failure of any one of these numerous components, the entire system fails, thereby causing reliability problems.

In yet another prior art patent, U.S. Pat. No. 4,919,346, to Joseph W. Chambers, Sr., entitled "ROTARY SCREEN DIVERTER AND SOLID WASTE HANDLING SYSTEM USING SAME", there is disclosed a solid waste handling system for screening and grinding liquid stream flowing within a chute between laterally spaced vertical sidewall utilizes at least one solids diverter horizontal rotating screen unit fixedly mounted within the chute and at an angle to the influent liquid stream with an endless loop open mesh screen mounted for rotation on a frame assembly such that upstream face of the screen is vertical and moves horizontally across the stream in a direction towards the downstream offset grinder unit. Multiple screen units and multiple grinder units may be employed in an stacked array, in end overlapping position, and with the endless screens driven to deflect (divert) solids toward one or more grinder units offset below the most downstream screen unit of the array. In an embodiment an upper and lower tensioner is provided to effect selective adjustment of the tension of the endless loop screen rotatably mounted on a drive shaft and assembly. This design has also been found to be excessively complicated in its construction thereby causing maintenance and reliability problems. The possible addition of tensioners suggests the that the elongated screen sages or looses tension during various stages of operation of the system resulting in loss of efficiency and effectiveness.

In still another U.S. Pat. No. 5,505,388, issued Apr. 9, 1996, to Joseph W. Chambers, et al, entitled "Integrated Diverter and Waste Comminutor", there is disclosed a comminutor system for diverting and reducing the size of waste materials in an effluent stream consisting of a frame housing having a cutter assembly, a single or dual cylindrical rotatable screen(s) and a drive motor means for actuating both the cutter assembly and the rotatable cylindrical screen (s). In operation the screen(s) are positioned adjacent to the cutter assembly, wherein the rotating cylindrical screen(s) is said to cause solids to be diverted in the effluent stream toward grinder unit for size reduction. In virtually every reference to the cylindrical screen(s) (diverters) are disclosed as rotating for purposes of causing the diversion of solid matter in the waste channel stream of flow. This prior art system, relies heavily upon know rotating members, especially rotating cylindrical techniques as a basis for the operation of its system and appears to be a simple and obvious modification of the prior art as disclosed in U.S. Pat. No. '346 issued to J. W. Chambers in which a horizontally moving screen is said to direct (divert) effluent flow into an adjacent shredder. While the present invention utilizes an unobvious and unique stationary screen with an interactive component to provide an effective and efficient means for diverting the solid matter in an effluent stream of a channel.

Several known problems exist with systems disclosed in both U.S. Pat. Nos. '346 and '388. As the rotating screens have no positive clearing means, solids captured thereon cannot be dependably removed from same. In order to help keep solids diverted by the rotation of the screens, the screen surfaces are made, in practice, with a ragged consistency to help move the solids. This in turn, negates the possibility of positioning the moving cylindrical or elongated screens close enough to the cutter area to provide complete processing of the material without the possibility of material by-passing the shredder and thereby proceeding upstream unprocessed. This is apparently why the disposition of the screen and cutter along the so called "tangent" is critical to operation as disclosed in U.S. Pat. No. '388. Another problem associated with the rotating screen or travelling screen is that solids can become trapped within the screen and as the screen rotates to the upstream side the pressure of the flow acts to flush the solids free of the screen thus allowing the solids to escape upstream unprocessed. Yet another problem associated with the rotating cylindrical or elongated screen design is when the unit is stopped for any reason when flow with entrained solids is present, solids can then accumulate in the screen and due to the lack of positive clearing tend to plug or "plaster" the screen. This can cause the unit not to function when re-energized and necessitates the difficult and time consuming manual dismantling of cleaning of the screen device. Still another problem associated with this design is the possibility of solids becoming trapped within the cylindrical or elongated screens, as described in U.S. Pat. Nos. '346 and '388, again requiring manual removal by the operator. While still another problem associated with the cylindrical or elongated rotating screen is breakage due to the liquid flow exerting pressure on the screens first on the outer circumference and then on the concave surface thereby causing fatigue from undulating bellowing of the screen element, especially when the screen is made of flexible material such as plastic elements. The principal distinction between the rotating cylindrical screen as disclosed in U.S. Pat. No. '388 as compared to the elongated horizontally rotating screen as described in U.S. Pat. No. '346 appears to be an inherent feature of the screen ridgity due to the cylindrical shape to help combat the fatiguing undulation problem.

In yet another prior art patent, Swiss Patent Ser. No. 298514, issued Jul. 16, 1954, to Dr.-Ing-Hellmut Geiger, there is disclosed an integrated system for diverting and reducing the size of waste materials in an effluent stream comprising a frame having a bottom housing and a top housing and mountable in the stream. A grinder unit is mounted to the frame bottom housing and comprises a cutter assembly positioned in the stream and a drive mechanism coupled to the cutter assembly to rotate the cutter assembly. The drive mechanism may be electrical or hydraulic. A screen unit is mounted to the frame. It may be a single or dual screens. The screen unit comprises a cylindrical screen rotating on a screen shaft having a screen shaft mounted on bottom housing of the frame and supporting the cylindrical screen. A drive assembly operably couples the drive mechanism to the screen shaft to rotate the cylindrical screen as the cutter assembly rotates. In operation with the screen unit positioned adjacent to the grinder unit it diverts solids in the effluent stream toward the grinder unit for size reduction. An auger-screen may be placed down stream for removal of large solids after size reduction.

Swiss patent '514 and U.S. Pat. No. '388 appear identical in structure and mode of operation, in that the diverter is a rotatable cylindrical screen disposed adjacent to a grinder unit. The screen arrangement may be a single or dual screens, whereby solids in the effluent stream are diverted toward the grinder unit owing to rotation of the screen(s) for size reduction. Both of these systems, '388 and 514 require rotation of the cylindrical screen member(s) to effect the diversion of solids in the effluent stream. All of the short comings and disadvantages of '388, noted herein, are also inherent in the structural configuration and operation of patent '514, and therefore do not provide the unique features or unexpected results achieved by the screening and sweeping functions taught by the present invention.

The foregoing prior art patents relate to the field of the present invention, however, it can be readily appreciated from a review of the foregoing prior art patents, that it is desirable to find a comminutor device and system that is simple and cost effective in construction and having low maintenance requirements while remaining rugged, efficient and effective for comminuting both small and large size matter contained in the flow of wastewater in a sewage channel at all levels in the liquid flow. The present invention employs a novel screening system employing a stationary semi-cylindrical screen with parallel slots constructed of high strength stainless steel or other corrosion and abrasion resitance material. The screen is positioned across the liquid flow containing solids of a rectangular wastewater channel and is used to capture the larger solids. From behind the screen, the teeth or tynes of a rotating comb-like member connected to and rotated by a vertical shaft, rotate on a radius greater than that formed by the screen and interact and intermesh with the screen slots. The tynes then protrude through the parallel slots. As the teeth encounter the solids trapped on the convex side of the stationary screen, they propel them towards an adjacent comminuting device while simultaneously clearing the screen slots with each revolution.

The advantages of the present invention are several fold. The solids are positively propelled to the shredder unit, to the side of the screening device. The screen slots are positively cleared with each revolution of the comb-like device thereby eliminating a difficult and long standing problem with the prior art rotating screen devices. There is no solids trapping within the two walls of a cylindrical screen and no backflush of solids as only one side of the screen always faces the same direction of the flow. The screen can be positioned much closer to the shredder blades as there is no issue of shaft alignments or cylindrical rotating screen tolerances or placement along any critical tangent as taught by U.S. Pat. No. '388 during assembly. Therefore, a higher percentage of solids are reliably captured and delivered to the shredder unit without by-passing the shredder. Unlike the prior art rotating cylindrical or elongated screens, the problems of screen plugging or "plastering" is eliminated by the present invention. In the prior art device using moving screens, the screen moves against the bottom or near bottom of the channel which contains a great deal of gritty material accumulation. This causes early screen wear. Since the screen of the present invention is stationary this problem is eliminated, thus extending the life of the screen and unit dependability.

BRIEF SUMMARY OF THE INVENTION

In accordance with the teachings of this invention, there is provided an integrated one piece or unitary comminuting system for wastewater channel use which include a stationary sweeping single or dual semi-cylindrical-like sizing screen member each having a rotating sweeping mechanism of interactive slotted comb bars or blades, with extending tynes or teeth, so as to sweep and clear lodged or agglomerated solids adhering to the outer circumference surface of the semi-cylindrical-like screen, disposed in spaced apart contiguous parallel relationship with a twin shaft shredder device having two parallel shafts with shredder or grinder teeth along the length thereof that rotate in opposite senses. The unitary system of devices may be positioned perpendicular between the influent and effluent sides of the wastewater flow in a channel so that solids therein will encounter the stationary semi-cylindrical-like sizing and sweeping screen members or the twin shaft shredder as the wastewater flows through the channel. Both the single or dual semi-cylindrical-like screen and sweeping devices cause solids which do not flow directly therethrough to be forcefully swept from the outer surfaces of the sizing screens by the rotating sweeping interactive blades, with tynes or teeth, mechanism into the surrounding wastewater flow so as to cause or direct the solids to flow into the twin shaft shredder device, aided by circulating wastewater currents generated in the wastewater flow near the entrance to the twin shaft shredder which is generated in part by the rotating sweeping interactive blades of the screening devices, whereupon the removed solids are efficiently channelled into the twin shaft shredder device along with the other wastewater and solids flow where they are reduced in particle size.

The system of the present invention has various advantages over known prior art devices, such as having a sizing screen comprising a plurality of parallel horizontal slots formed therein which extend the full circumferential length of the screen, that is constructed as an integrated one piece or unitary stationary semi-cylindrical-like structure of durable stainless steel or other suitable wear resistant material which is highly resistant to corrosion, abrasion and deformation. This type of structural construction results in a rugged and durable low or no maintenance screen device. In a similar manner a rotating sweeping mechanism of interactive slotted comb bars with protruding tynes or teeth, which may be alternately called a rotatory sweeper, consists essentially of a rectangular slotted comb mounted to or formed as a part of a rugged rectangular frame on two stub shafts diametrically disposed to one another and extending perpendicular to the flow of wastewater such that a tooth or tyne protrudes a predetermined distance through each slot of the stationary sizing screen, and may be made of stainless steel or any other suitable durable materials. It should be understood that such frames may have multiplestub shafts. The mounted form of slotted comb bars are readily replaceable in the event they become damaged during operation. It should be noted that a comb-like arrangement may be formed directly along the edge of the arms of the frame. During its operation the comb teeth or tynes protrude through each screen slot toward the downstream side of the screen far enough to sweep and clear solids from the front circumferential surface of the sizing screen into the waste stream and contiguous shredder device. In another embodiment of the invention, the rotatable frame may have its sweeper disposed on the upstream side of the waste stream while the stationary screen member on the downstream side of the waste stream. In this arrangement, the tynes or teeth are not required to protrude through the slots, since the waste matter are collected on the inner convex surface of the screen, wherein they are swept and cleared therefrom during multiple rotatory cycles or sweeps of the rotating frame member. Both of these arrangements operate to provide particle sizing in an efficient manner.

BRIEF DESCRIPTION OF THE DRAWINGS

The invention can be described in more detail with the help of the accompanying drawings wherein.

DETAILED DESCRIPTION

Figure 1:
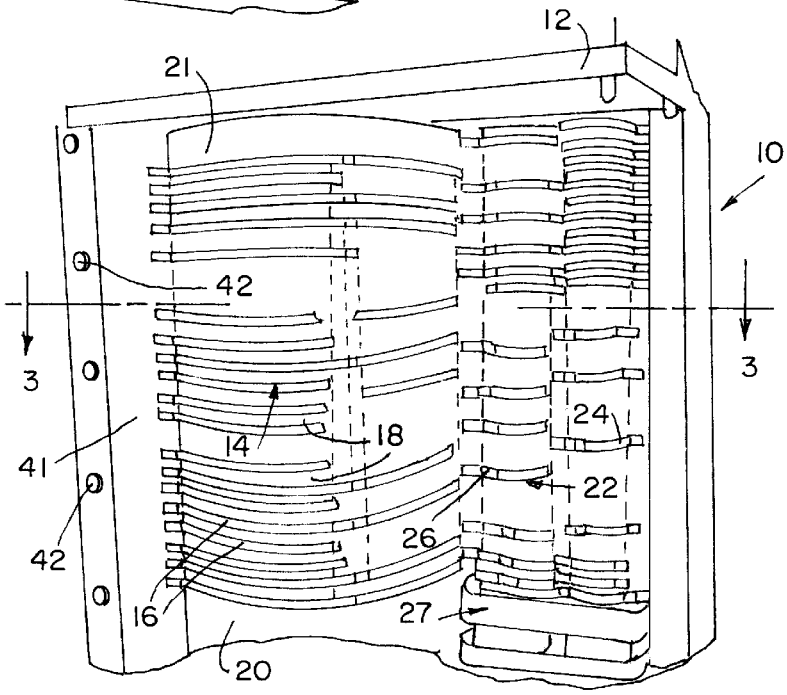
FIG. 1, shows the system of the present invention when viewed from upstream, depicting the one piece system comprising a sizing screen in juxtaposition with the twin shaft shredder.

Shown in FIG. 1, is an integrated one piece or unitary system 10 comprising a support structure 12, useful for supporting the various devices mounted thereon, a rugged stationary sizing screen cage structure 14 containing a plurality of horizontally parallel cage ribs or elements 18 forming a corresponding plurality of sizing screen slots 16 formed by alternate ribs 18. At the bottom of cage 14 is a larger bottom segment 20 and an upper segment 21 of sizing screen cage 14 both of which tend to provide strength to cage 14. Disposed in juxtaposition to cage 14 and mounted on support structure 12 along with cage 14, is a twin shaft shredder 22, having a first parallel twin shredder 24 and a second parallel twin shredder 26, each having a plurality of shredding teeth extending the length thereof for interactive rotational relationship therebetween, for shredding and grinding matter into minute particles as such matter passes therethrough. The twin shredders 24 and 26 are rigidly supported adjacent to sizing screen cage 14 by support structure 12 and a bearing device 27 disposed a the bottom of the two twin shredders 24 and 26 and firmly attached to support structure 12 and a gear box 32 which is in turn connected to a first drive motor 28 shown in FIG. 2. The detail operation and construction of twin-shaft grinders is well known in the prior art by those skilled in the art and therefore, are not discussed in greater detail herein. Continuing with the description of FIG. 1, there is shown a mounting section 41 as part of cage 14, which enables the sizing screen cage 14 to be attached firmly to support structure 12 by means of a plurality of bolts 42. A remote section of cage 14 is connected to support structure 12, and can be seen clearly in FIG. 3.

Figure 2:
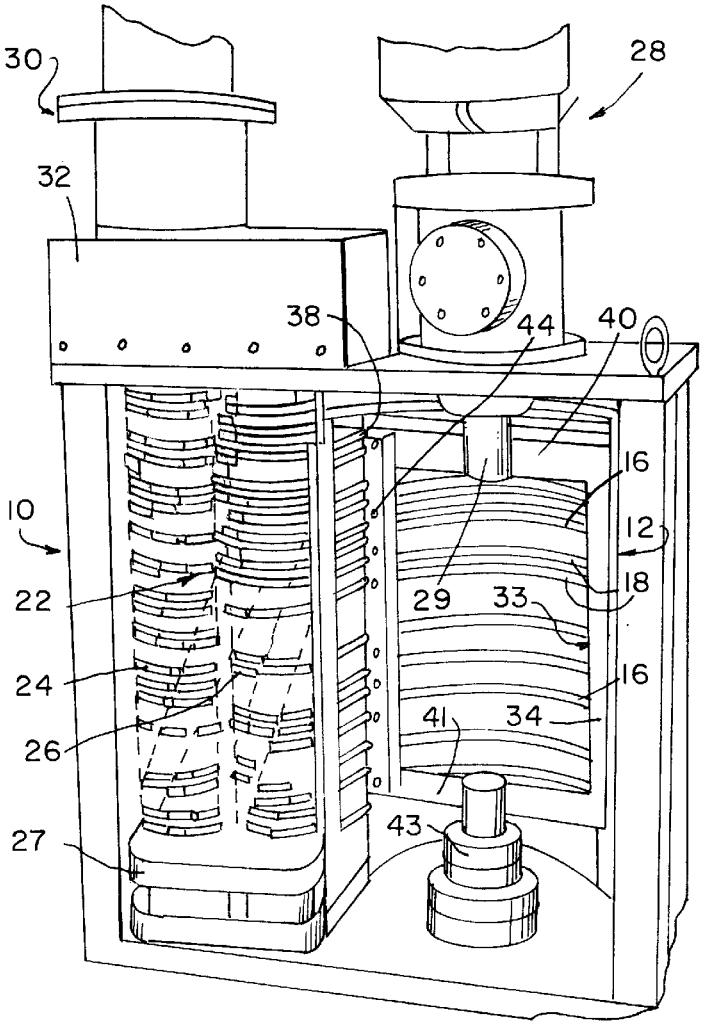
FIG. 2, shows the system of FIG. 1, as viewed from a downstream position.

Referring now to FIG. 2, there is shown a view of FIG. 1 viewed from a downstream position. As shown the reverse sides of sizing screen 14, twin shaft shredding device 22 can be seen. As shown there is a first drive motor 28 connected to a main rotatable frame 33, having two vertical sections 34 that extend the length of cage 14, and a pair of upper sections 40 and a pair of lower sections 41, all connected to form a rectangular-like frame structure. The top of the frame-like structure is connected to a rotatable shaft 29 of first motor drive 28, while the bottom of main frame-like structure is supported by a frame support bearing member 43. Also shown in FIG. 2, there is seen a cutter comb 36 that extends the length of frame 33 along the vertical sections 34 and is mounted thereto by a plurality of bolts 44. Cutter comb 36 has a plurality of tynes or teeth 38 extending horizontally therefrom so as to protrude through sizing screen slots 16 a preselected distance. The extent of protrusion of the teeth through the slots can more readily seen by referring to FIG. 3. It is to be understood that teeth or tynes of the type shown for the comb 36 may be formed along the leg of the frame where comb 36 is shown mounted. Continuing with the description of FIG. 2, there is shown a second drive motor 30, for driving twin shaft shredder 22 connected thereto through a transmission gear box 32. The gear box 32 holds the twin shaft shredder at its top while bearing support device holds its at the bottom providing for smooth rotation of both shredders as they interact with one another while shredding matter passing therethrough.

Figure 3:
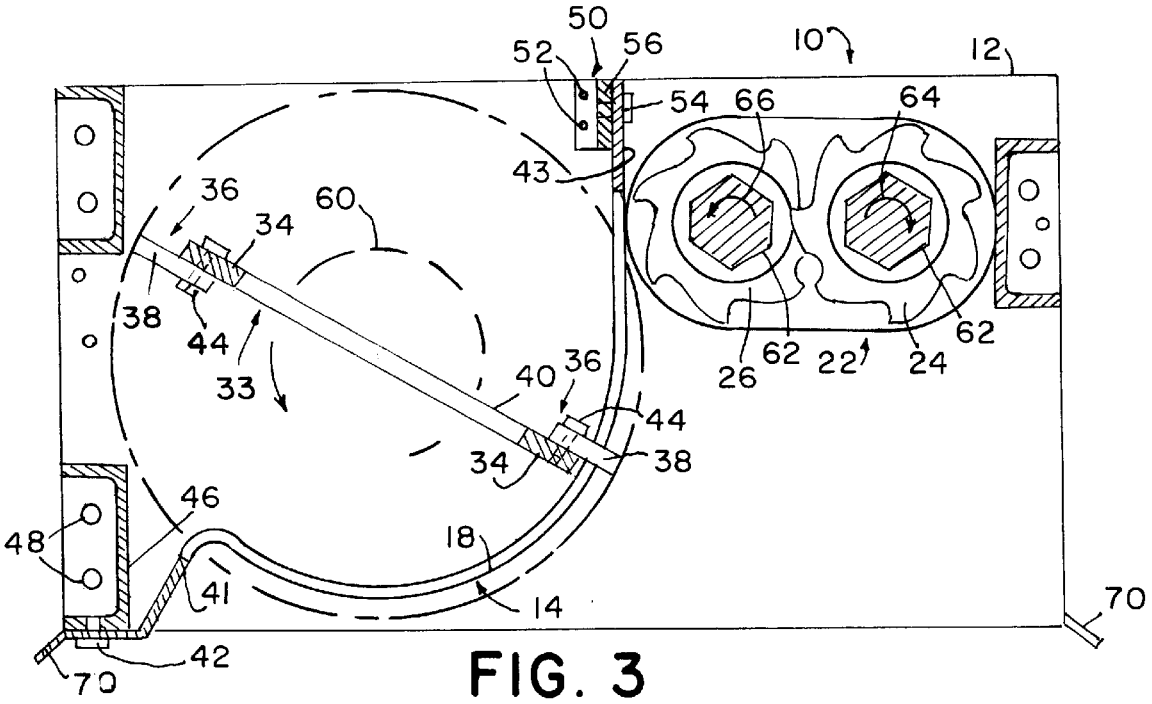
FIG. 3, is an illustrative view of the system shown in FIG. 1, taken along the line designated 3—3, in FIG. 1.

FIG. 3, is an illustrative view of the unitary system 10, taken along line 3—3 of FIG. 1, showing the various elements of the system. As seen sizing screen cage 14 has a semi-cylindrical-like structure where the full outer circumferential surface of screen 14 faces the upstream flow of liquid sewage flowing in a channel during its operation. Cage rib or element 18 is shown as exposed, while the cross-sectional portions shown as sections 41 and 43 and are utilized to mount the screen cage. Section 41 is connected to a support member 46 that is connected to support structure 12 by several bolts 48. Section 41 of cage 14 is connected to support member by a plurality of bolts 42, to thereby firmly secure the cage on the front end thereof. The other end of cage 14 is connected to another support member 50 connected to support structure 12 by several bolts 52, while section 43 of sizing screen 14 is connected support member 50 by means of a plurality of spaced apart bolts 54 which are located along the full vertical length of cage 14 and support member section 56. The connection of sections 41 and 43 of sizing screen cage 14 to their respective support members holds them rigidly and strongly in place within the system arrangement. Continuing with the description of FIG. 3, there is shown a main frame-like rotatable member 33 with two vertical sections 34, in cross-section, and a lower frame member 43. Connected to each vertical members 34 is a cutter comb member 36 by means of a plurality of spaced apart bolts 44 extending the full length of frame section 34. Sweeper comb-like member has a plurality of spaced apart tynes or teeth along the entire length of cutter and sweeper comb-like member, wherein the number of teeth correspond to the number of slots contained in the sizing screen cage 14. The vertical thickness of teeth is slightly less the height of slots 16 formed in each cage configuration so as to permit smooth rotational operation of the teeth through slots 16, while providing enough thickness to insure ample mass and strength to perform the function of removing and clearing matter that may land upon the outer circumferential surface of sizing screen cage 14. The direction of rotation of frame member 33 is shown by the broken line designated 60.

Also in FIG. 3, there is shown twin shaft shredder device 22, partly in cross-section, deposed in juxtaposition to sizing screen cage 14. A pair of twin shafts 62, partly in cross-section, having twin shaft shredder 24 and 26, respectively disposed thereon for interactive rotation. As shown by the curved arrows 64 and 66, twin shredders 24 and 26, respectively rotate in opposite senses to cause the interactive grinding and shredding action therebetween.

Figure 4:
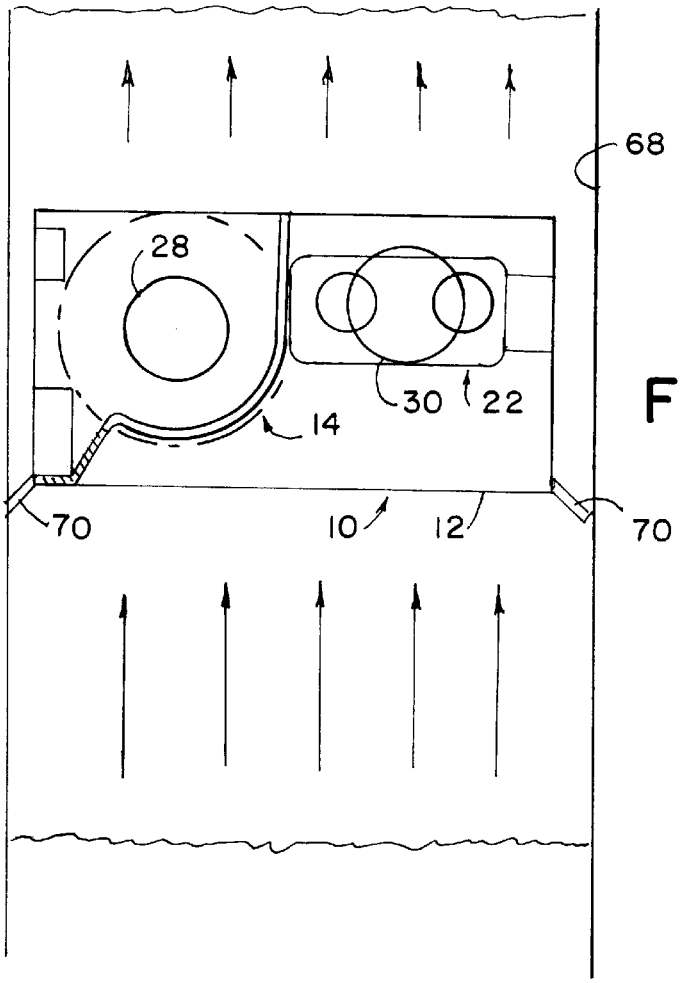
FIG. 4, is an illustrative view of the system of FIG. 1, disposed in a typical sewage flow channel showing the orientation of the system with respect to upstream and downstream sewage flow.

Referring to FIG. 4, there is shown an illustrative view of the system of FIG. 1, disposed in a typical sewage flow channel showing the orientation of the system with respect to the upstream and downstream sewage flow within a channel as depicted by walls 68. As shown there is a fixed or adjustable pair of flange or baffle members 70, one disposed on either side of the support structure 12, for purposes of preventing any sewage from flowing to either side of the system. Members 70 extend the full length of the system 10 so as to enable the apparatus to equal the width of channel 68, from the bottom of the channel 68 to top of support structure 12, to a position well above the highest level of sewage flow in channel 68.

Figure 5:
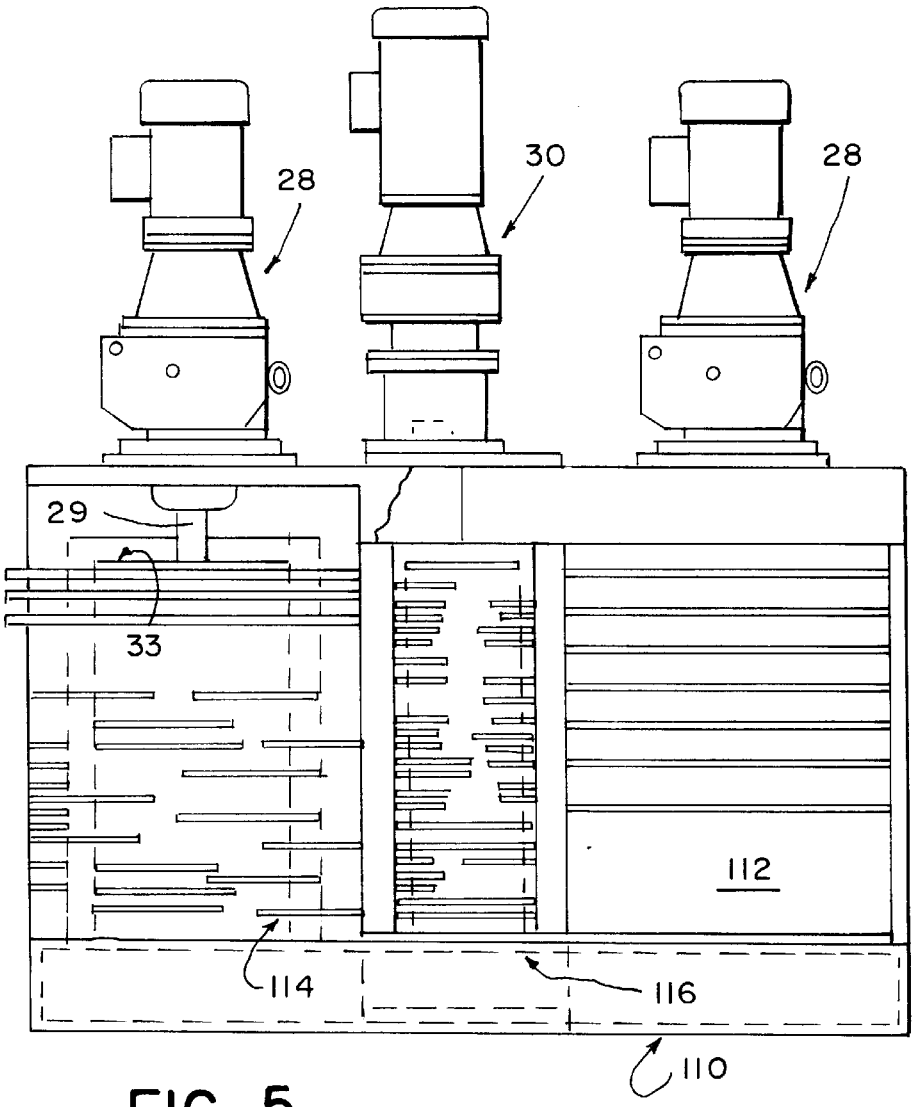
FIG. 5, is an illustrative view of a dual sizing screen arrangement disposed on either side of the twin shaft shredder.
Figure 9:
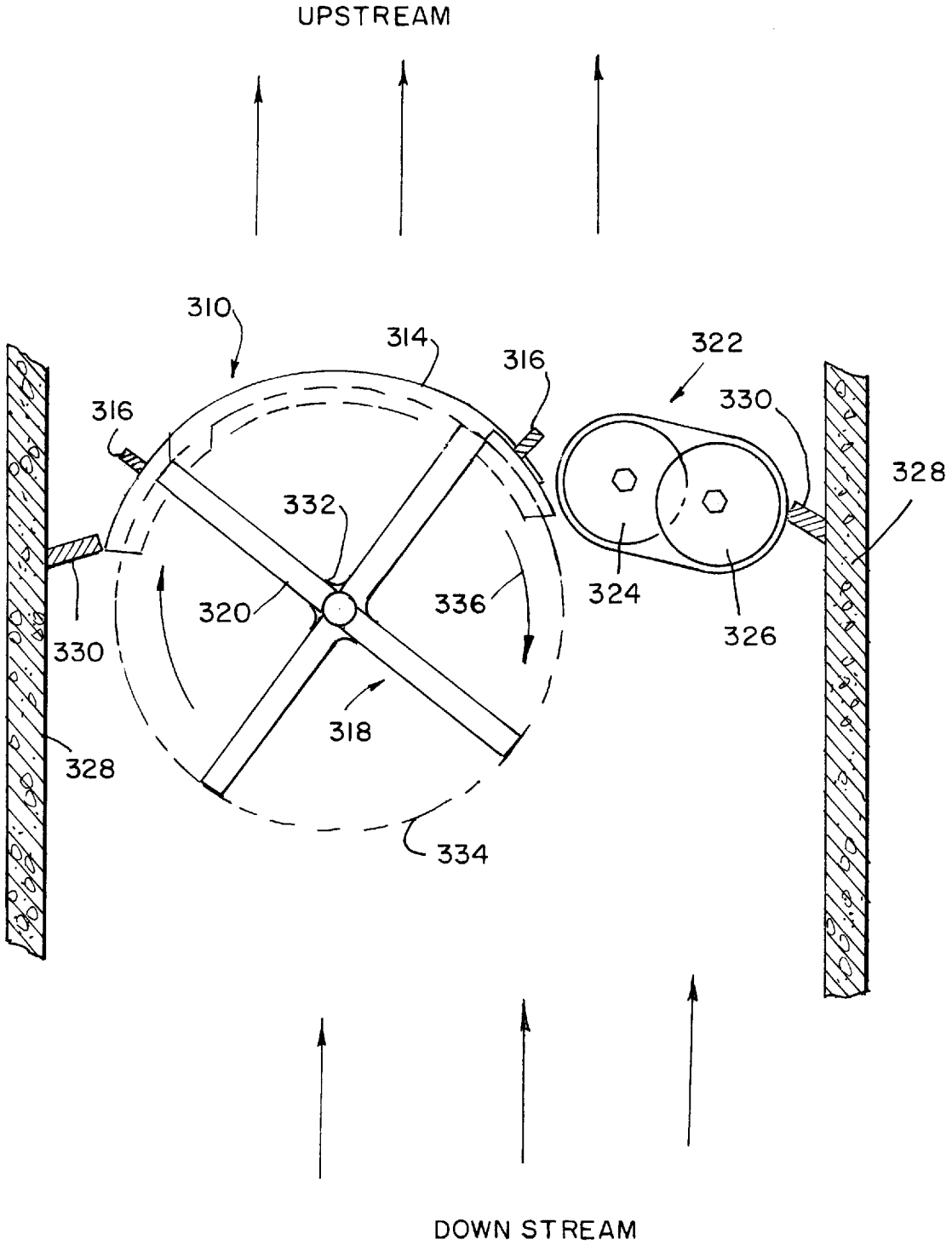
FIG. 9, is an illustrative partial cross-sectional view of the invention wherein the stationary semi-cylindrical-like sizing and sweeping screen member and the rotating sweeping mechanism are in a reversed relationship to that shown in FIGS. 1 and 2.

Referring now to FIG. 5, there is another embodiment of the present invention shown as an illustrative view of a system 10 in accordance with teachings of the present invention, having dual sizing screens devices 112 and 114, respectively disposed on either side of a twin shaft shredder 116. The devices 114 and 116 are the same as those described in FIGS. 1–3, while the sizing screen cage 112 is constructed as the reverse of sizing screen cage arrangement 114 and the rotation of its main frame-like structure is identical to structure 33 used in device 112, but it rotates in the opposite sense as that of device 114. Thus, both frames of sizing screen devices rotate in such a manner that matter landing on their respective screens is cleared therefrom and directed toward the twin shredder device 116 where such matter is reduced by grinding and shredding on passing therethrough.

Figure 6:
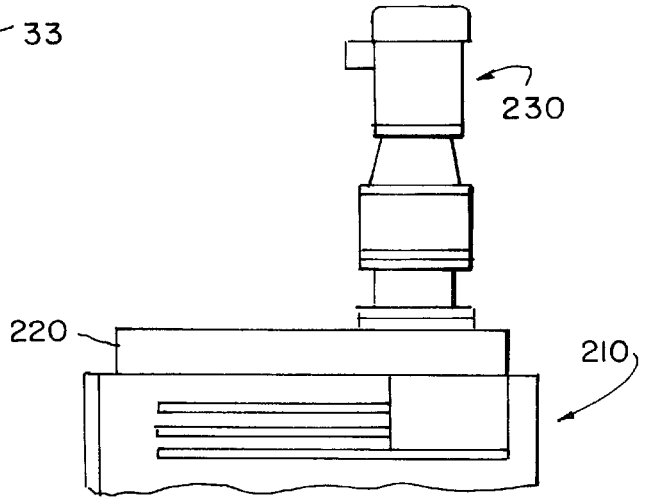
FIG. 6, is an illustrative view of another embodiment of the present invention shown in FIG. 1, wherein the sizing screen and twin shaft shredder devices are driven in rototary motion by a single drive motor and an associated interactive gearing arrangement.

Referring to FIG. 6, there is shown another embodiment of the present invention, consisting of a system 210 that is similar in construction and operation to the system 10 of FIG. 1, except that system 210 has a single drive motor 230 and an associated cooperative gearing device that is contained in an enclosure 220. The gearing device with the arrangement of gears may be a conventional arrangement of gears known in the prior art. The operative arrangement utilized in connection with the system of FIG. 6, has the advantage of being cost competitive and effective to prior art devices and the system describe in FIG. 1, owning to the use of only one drive motor. It has been found that certain uses and applications of the present invention do not require extra drive power of two provided by the system disclosed in FIG. 1, and consequentially the single drive motor and gearing arrangement utilized have been found to be adequate to provide effective and efficient operation for such uses and applications. It is understood that the adaptations discussed hereinabove with respect to FIG. 6, as contrasted to FIG. 1, is also applicable to an adaptation of the system of FIG. 6, so that a dual sizing screen configuration is provided similar to that illustrated in FIG. 5, except that a single drive motor and gear device arrangement similar to that disclosed in connection with FIG. 6, is utilized that drives the two sizing screens and a twin shaft shredder.

Figure 7:
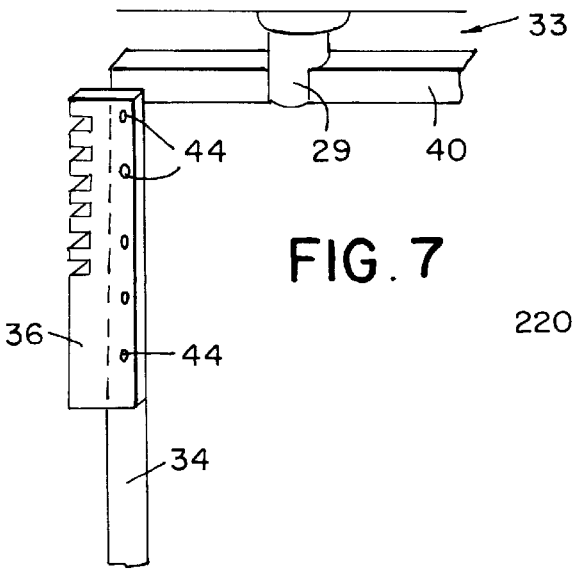
FIG. 7, is an illustrative partial view of the main rotatable frame and cutter comb shown in FIG. 2.

In FIG. 7, there is shown a partial view of the main rotatable frame 33 and cutter comb 36 connected thereto along one leg 34 of the frame. The frame is connected at its upper frame member to a shaft 29 from a first drive motor 28, not shown, to provide rotatory motion for frame 33, as it interacts with the slots of sizing screen cage 14, not shown.

Figure 8:
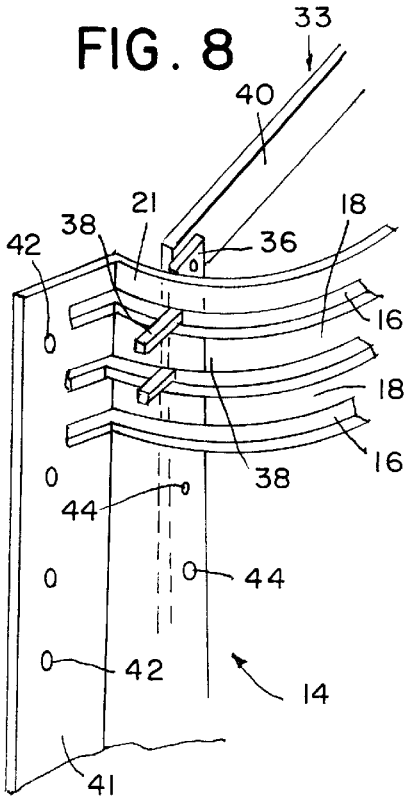
FIG. 8, is an illustrative partial view of the main rotatable frame and cutter comb in interactive relationship with the slots of the sizing screen cage shown in FIGS. 1 and 2.

In FIG. 8, there is shown an enlarged partial view of the main rotatable frame 33 and cutter comb 36 in interactive spaced relationship with the slots 16 of the sizing screen cage 14 shown in FIGS. 1 and 2. FIG. 8, clearly shows how the tynes or teeth 38 of cutter comb 36 are in an interactive spaced relationship with the slots 16 of sizing screen 14. In operation as the main frame 33 is caused to rotate by drive motor 28, the teeth 38 of comb 36 traverse slots 16 in a circular motion clearing and/or shredding all solid matter that impacts the outer semi-cylindrical surface of the sizing screen 14. In addition to clearing the outer surface of the screen member the rotatory motion of the cutter comb with protruding teeth 38 create turbulence in the channel flow near the twin shaft shredder 22 causing solids to be forcibly directed into the twin shaft shredder device 22.

In its operation, the comminuting system in accordance with the teachings of the present invention is unique in that the solid matter suspended in the liquid flowing in the channel is aggressively acted upon and processed whether the solid matter is agglomerated sludge-like material or bulky items. As the solid matter suspended in the liquid flow travels or floats toward the comminuting and screening system contained in a channel, to the full depth of the liquid flow, all matter that is too large to flow freely through the sizing screen and shredder is intercepted. As soon as any solid or agglomerated matter is pushed onto the surface of the sizing screen it is immediately and continuously sweep therefrom by the rapidly rotating teeth of the cutter and sweeper comb during multiple rotational cycles thereof. The frequency of the rotation cycles of the sweeper teeth is determined and limited only by the speed and torque of the drive motor utilized to rotate the frame-like member to which the comb sweepers are attached. It should be recognized that if the quantity of solid matter suspended in the liquid flow is massive, the through-put flow of liquid could be some what reduced. However, it has been observed after many hours of system operation, that over time the reduction in through-put only occurs if the bulky items, such as broken glass, metal containers and large plastic items are permitted under unusual circumstance to accumulated in the liquid flow. The dynamic sweeping action of the rotating teeth repeatedly drive such material into the twin shaft shredder until it is crushed and shredded to thereby eliminate the possibility of any significant reduction in flow through. This present dynamic feature of comminuting system in accordance with the teachings of the present invention is deemed unique and effective to the operation of the system, and is not known or not believed to exist in the prior art devices.

Continuing with the description, operation of the system in accordance with the present invention provides several advantages over known prior art systems and devices. These advantages include, a) an increase in flowthrough of flowing liquid substance having solid matter suspended in it, some of which may bulky objects; b) the system is simple but effective in its construction, that is the sizing screen comprises four essential components, a one piece rugged sizing screen member, a rotatable frame member, a pair of cutter combs with protruding cutting, grinding and clearing teeth, and a drive motor or other suitable rotational means connected to the rotatable frame for rotating it at preselected speeds; c) the sizing screen is rugged and resistant to corrosion, abrasion and distortion owing to the fact that it is formed of high strength stainless steel capable of withstanding significant abuse; d) the sizing screen arrangement along with the rotating interactive cutting, grinding and clearing teeth provides continuous rapid efficient clearance and and sweeping removal of solid matter intercepted by it at all levels in the channel liquid flow; e) the clearing and removal of solid matter from the outer surface of the sizing screen tends to cause some turbulence in the liquid flow within the channel near the twin shaft shredder such that such removed solid matter is directed sideways into the direct flow path of liquid flowing into the twin shaft shredder; and f) the processing capabilities of the system may readily be increased by the addition of a second sizing screening device which is disposed in fixed juxtaposition with the twin shaft shredding device, such that twin shredder device is in fixed tandem spaced relation between the two sizing screens.

The foregoing disclosure and teachings of the present invention readily and adequately demonstrated that the simple and unique construction provides a system which allows the sewage liquid being processed to flow therethrough with minimum hinderance. In addition, the sizing screen member is more rugged and resistant to impact and corrosion by solid matter than prior art screens. The self cleaning properties of the rotating tynes or teeth of the cutter comb insures that no matter or solids which impacts the screen will remain on the screen circumferential surface long enough to cause any significant damage to the screen prior to its rapid removal. In addition, the turbulence generated by the rapidly rotating cutter comb with protruding teeth tend to direct sewage flow toward the twin shaft shredder for more efficient and rapid shredding and grinding, to thereby enhance the performance and efficiency of flow through the system. While the use of a single rotational means to drive the various moving parts of any apparatus may be advantageous, the use of the novel screening arrangement in accordance with the teachings of the present invention is most important when accessing whether one or more drives is utilized.

It should be understood that the above described embodiments are only illustrative of the principles applicable to the invention. Various other arrangements and modifications may be defined or devised by those skilled in the art without departing from the spirit and scope of the invention. Consequently, is it understood that the present invention is limited only by the disclosure and appended claims hereof.

What is claimed as new is:

1. A system and apparatus for screening, shredding or grinding and moving a flowing liquid substance having solid matter suspended in it, said combination comprising:

(a) a channel along which the liquid substance flows having solid matter suspended therein, an integrated one piece device suitable for screening and shredding said solid matter suspended in the liquid substance, moveably disposed in said liquid substance flow to act as a barrier to the flow of large pieces of suspended solid matter until they are reduced to minute particles;

(b) a one piece device including a sizing screen disposed in fixed juxtaposition to a twin shaft shredding device on a support structure, said sizing screen having a semi-cylindrical-like screening member having a plurality of horizontal parallel slots formed therein and being disposed in the flow path of said liquid substance and having a length extending to the full depth thereof so as to intercept large size solid matter suspended therein on a semi-cylindrical surface thereof, said intercepted solid matter is cleared and removed from said surface and is effectively diverted laterally to the direction of flow of said liquid substance into an area near said twin shaft shredder by a motor driven means rotating frame-like member that operates and interacts with said screen having one or more comb-like cutter and sweeping members extending the full length of said screen having a plurality of teeth extending horizontally therefrom for protruding through said slots of said screen a distance sufficient to effectively remove and clear said intercepted solid matter from the surface of said screen as said cutter teeth completes multiple interacting and sweeping cycles of rotation through said screen slots;

(c) said twin shaft shredder includes two motor driven shafts whose lengths extend to the full depth of said liquid substance, that rotate in opposite sense to one another, each shaft having a shredding member disposed thereon extending the full length thereof for shredding and grinding solid matter of said liquid substance as it flows into said twin shaft shredder device;

d) a first drive motor means mounted on said one piece device and connected to said frame-like member to provide rotational motion thereto; and a second drive motor means mounted to said one piece device and connected to a gearing device that is in turn connected to said two drive shafts of said twin shaft shredder to provide rotational motion thereto so, that said two shafts rotate in opposite senses; and (e) a fixed or adjustable baffle member attached to each side of said support structure and extending at least the full depth of said channel, so that the width of said apparatus is equal to the width of said channel so as to prevent said solid matter from flowing past said apparatus without passing through said sizing screen or twin shaft shredder.

2. A system in accordance with claim 1, in which said sizing screen is made of stainless steel or suitable wear resistant material.

3. A system in accordance with claim 2, in which said comb-like cutter is firmly mounted to said cutter and is made of stainless steel or other suitable wear resistant material.

4. A system in accordance with claim 3, which further includes a second sizing screen and frame-like member, whose orientation and the direction of rotation of its frame-like member are the reverse of that of the other sizing screen frame-like member, are disposed in fixed juxtaposition to said twin shaft shredding device, such that the twin shaft shredder is disposed in fixed tandem relationship between the two sizing screens, and said second sizing screen device having its separate drive motor means connected thereto.

5. A system in accordance with claim 4, in which the rotational speeds of said drive motors are controlled by means of adjustment.

6. A system and apparatus in accordance with claim 5, in which the apparatus is further defined as portable.

7. An improved comminuting apparatus being moveably disposed in a channel for screening, and shredding and crushing of solid matter suspended in a channel carrying liquid containing liquid of flowing substances, such as sewage and the like, the combination comprising:

(a) a one piece device including a sizing screen disposed in fixed juxtaposition to a twin shaft shredding device, said sizing screen having a semi-cylindrical-like screening member having a plurality of horizontal parallel slots formed therein and being disposed in the path of said liquid substance flow and extending to full depth thereof so as to intercept large size solid matter suspended therein on a semi-cylindrical surface thereof, said intercepted solid matter is cleared and removed from said surface and is effectively diverted laterally to the direction of flow of said liquid substance into an area of said twin shaft shredder by a motor driven rotating frame-like member that operates and interacts with said screen having one or more comb-like cutter and sweeping member extending the full length of said screen with a plurality of teeth extending horizontally therefrom and protruding through said slots of said screen a distance sufficient to effectively remove and clear said intercepted solid matter from the surface of said screen as said cutter and sweeping teeth completes multiple interacting cycles of rotation through said screen slots;

(b) said twin shaft shredder includes two motor driven shafts whose lengths extend to the full depth of said liquid substance, that rotate in opposite sense to one another, each shaft having a shredding member disposed thereon extending the full length thereof for shredding and grinding solid matter of said liquid substance as it flows into said twin shaft shredder device, said twin shaft shredder being disposed and connected in junta-position to said sizing screen both of which are supported by a support member;

(c) a first drive motor means mounted on said one piece device and connected vertically to said frame-like member to provide rotational motion thereto; and a second drive motor means mounted to said one piece device and connected vertically to a gearing device that is in turn connected to said two drive shafts of said twin shaft shredder to provide rotational motion thereto so, that said two shafts rotate in opposite senses; and (d) a fixed or adjustable baffle members attached parallel and vertically one on each side of said support structure and extending at least the full depth of said channel, so that the width of said apparatus is equal to the width of said channel so as to prevent said solid matter from flowing past said apparatus without going through said sizing screen or twin shaft shredder.

8. An improved apparatus in accordance with claim 7, in which said sizing screen is made of stainless steel or any wear resistant material.

9. An improved apparatus in accordance with claim 7, in which said comb-like cutter is firmly mounted to said frame-like member and is made of stainless steel or any suitable wear resistant material.

10. An improved apparatus in accordance with claim 9, which further includes a second sizing screen and frame-like member whose orientation and the direction of rotation of its frame-like member are the reverse of that of the other sizing screen, is disposed in fixed juxtaposition to said twin shaft shredding device, such that the twin shaft shredder is disposed in fixed tandem relationship between the two sizing screens and frame-like members, and said second sizing screen device has its own separate drive motor connected thereto.

11. An improved apparatus in accordance with claim 10, in which the rotational speeds of said drive motors are controlled by means of adjustment.

12. An improved apparatus in accordance with claim 11, in which the apparatus is further defined as portable.

13. A system and apparatus for screening, shredding or grinding and moving a flowing liquid substance having solid matter suspended in it, said combination comprising:

(a) a channel along which the liquid substance having solid matter suspended therein flows and a one piece device suitable for screening and shredding said solid matter suspended in the liquid substance moveably disposed into said liquid substance flow to act as a barrier to the flow of said suspended solid matter until they are reduced to minute particles;

(b) a one piece device including a sizing screen disposed in fixed juxtaposition to a twin shaft shredding device, said sizing screen having a semi-cylindrical-like screening member having a plurality of horizontal parallel slots formed therein and being disposed in the path of said liquid substance flow and extending to full depth thereof so as to intercept large size solid matter suspended therein on a semi-cylindrical surface thereof, said intercepted solid matter is cleared and removed from said surface and is effectively diverted laterally into the direction of flow of said liquid substance into an area of said twin shaft shredder by a motor driven rotating frame-like member that operates and interacts with said screen having one or more comb-like cutter and sweeping membere having a plurality of teeth extending horizontally therefrom and protruding through said slots of said screen a distance sufficient to effectively remove and clear said intercepted solid matter from the surface of said screen by means of sweeping as said cutter teeth completes multiple interacting cycles of rotation through said screen slots, said screen and rotatable frame-like member are dispose to one side of said shredder;

(c) said twin shaft shredder includes two motor driven shafts whose lengths extend to the full depth of said liquid substance and rotate in opposite sense to one another, each shaft having a shredding member disposed thereon extending the full length thereof for shredding and grinding solid matter of said liquid substance as it flows into said twin shaft shredder device, said twin shaft device has two sides;

d) a drive motor mounted on said one piece device and operately connected to said frame-like member associated with said sizing screen and to said twin shaft shredder to provide independent rotational motion to said frame-like member and twin shaft shredder, said two motor driven shafts rotate in oppose senses to one another; and (e) a fixed or adjustable baffle members attached parallel and vertically, one on each side of said support structure and extending at least the full depth of said channel so that the width of said apparatus is equal to the width of said channel so as to prevent said solid matter from flowing pass said apparatus without going through said sizing screen or twin shaft shredder.

14. An improved apparatus in accordance with claim 13, in which said sizing screen is made of stainless steel or any suitable wear resistant material.

15. An improved apparatus in accordance with claim 13, in which said comb-like cutter is firmly mounted to said frame-like member and is made of stainless steel or any wear resistant material.

16. An improved apparatus in accordance with claim 13, which further includes a second sizing screen and rotatable frame-like member that are configured to operation as the first sizing screen and rotatable frame-like member arrangement, where they are disposed on opposites sides of said twin-shaft device such that the twin shaft shredder is disposed in fixed tandem relationship between the two sizing screens and the direction of rotation of the second frame-like member is the reverse of that of the other sizing screen arrangement, both said sizing screen devices and twin-shaft shredder device are driven by a single motor and gearing arrangement operately connected thereto.

17. An improved apparatus in accordance with claim 16, in which the rotational speed of said drive motor is controlled by means of adjustment.

18. A system and apparatus in accordance with claim 16, in which the apparatus is further defined as portable.

19. A system in accordance with claim 13, in which the rotational speed of said drive motor is controlled by means of adjustment.

20. A system and apparatus in accordance with claim 13, in which the apparatus is further defined as portable.

21. An improved apparatus for screening and diverting solid material contained in a fluid stream flow, the combination comprising:

(a) a one piece stationary sizing screen member having a semi-cylindrical-like screening surface with a plurality of parallel slots formed therein for sizing material particles and being disposable in the path of a fluid stream flow containing material particles and extending the full length thereof, large solid material particles intercepted by said screen are cleared and removed from said screening surface and are effectively directed essentially sideways into the path of flow of said fluid stream;

(b) a rotatable driven frame-like member that is associated with and disposed in rotational interaction spaced relationship with said screen, said frame-like member having one or more vertical members with comb-like sweeping and cutting edges having a plurality of tynes or teeth extending horizontally therefrom so as to protrude through said screen slots a distance sufficient to effectively remove and sweep clear said intercepted solid materials from the surface of said screening surface as said cutter and sweeping comb-like sweeper completes multiple cycles of rotation through the screen slots; and (c) a drive motor means operately connected to said frame-like member to provide rotational motion to said frame-like member for meshing and sweeping action with said slots of said screen.

22. An apparatus in accordance with claim 21, in which said fluid stream flow is a liquid stream flow.

23. An apparatus in accordance with claim 22, in which said liquid stream flow is a waste liquid stream flow with material solids suspended therein.

24. An apparatus in accordance with claim 21, in which said screen is disposed to encounter said fluid steam flow first, and said frame-like member is disposed to encounter said fluid stream flow thereafter.

25. An apparatus in accordance with claim 24, in which the position of said screen and frame-like members are in reversed positions, and said comb-like sweeping edges do not protrude through said slots, they extend only a selected distance into said slots.

* * * * *